United States Patent [19]

Youngquist

[11] 4,085,308

[45] Apr. 18, 1978

[54] ELECTRIC WATER HEATER FOR SHOWERS

[76] Inventor: Rex Veech Youngquist, 7800 SW. 67th St., Miami, Fla. 33143

[21] Appl. No.: 745,199

[22] Filed: Nov. 26, 1976

[51] Int. Cl.[2] ..... H05B 1/02; H05B 3/82; F24H 1/10

[52] U.S. Cl. ..... 219/309; 137/341; 174/52 PE; 219/306; 219/314; 219/541; 222/146 HE

[58] Field of Search ..... 219/296–309, 219/314, 541; 137/341; 222/146 R, 146 H, 146 HE; 174/52 PE

[56] References Cited

U.S. PATENT DOCUMENTS

| | | | |
|---|---|---|---|
| 1,057,760 | 4/1913 | Miles | 219/305 |
| 1,646,912 | 10/1927 | Hodshon | 219/304 |
| 1,805,885 | 5/1931 | Rinderspacher et al. | 219/299 |
| 2,886,884 | 12/1958 | Minier | 219/306 X |

FOREIGN PATENT DOCUMENTS

| | | | |
|---|---|---|---|
| 224,715 | 3/1958 | Australia | 219/308 |
| 47,874 | 2/1940 | Netherlands | 219/298 |

*Primary Examiner*—A. Bartis
*Attorney, Agent, or Firm*—Hall & Houghton

[57] ABSTRACT

The heater has various provisions which severally and in combination improve its life, protect it from overheating and burnout under all operating conditions, and adapt it for shower use with maximum safety. These include a special arrangement with a water pressure responsive switch of a heating unit of the type having a rigid tubular housing so as to effect adequate heating with relatively low current density, provision for confining the heating of said unit to portions thereof which are fully submerged in water during operation, provisions affording air chamber means for accommodating exudations from the heating unit and facilitating operation of the pressure responsive switch, provisions for lockingly enclosing its insulating electrical housing and for encapsulating with the aid of potting compound all electrical elements of the device.

10 Claims, 4 Drawing Figures

FIG. 1
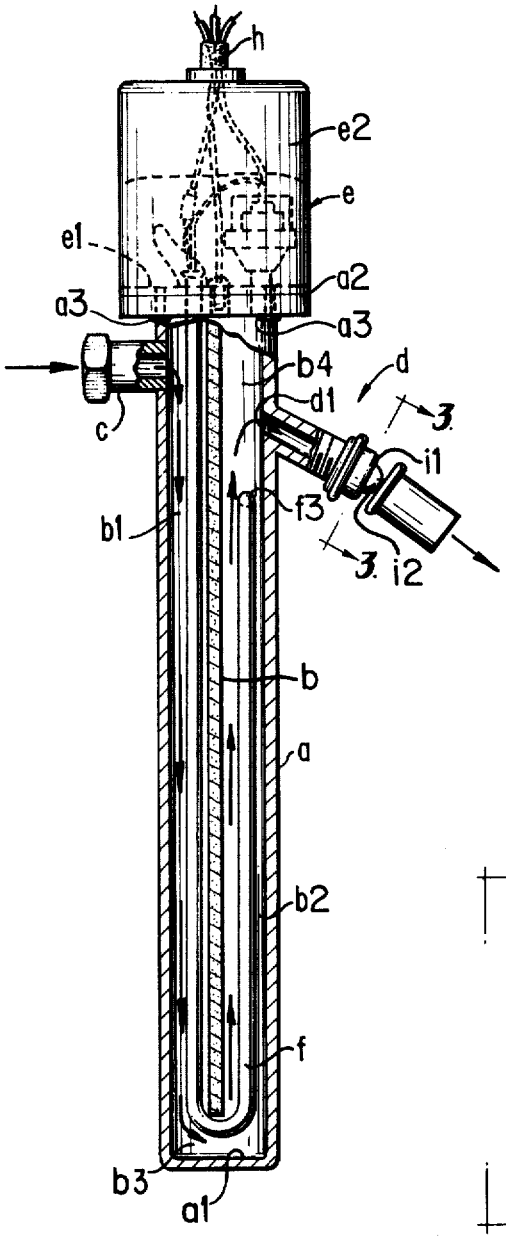
FIG. 2
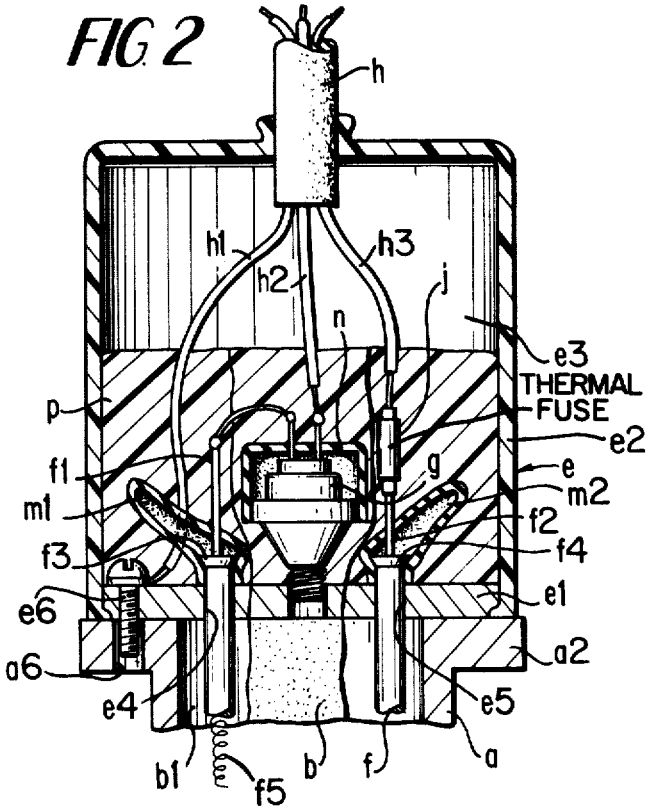
FIG. 1a
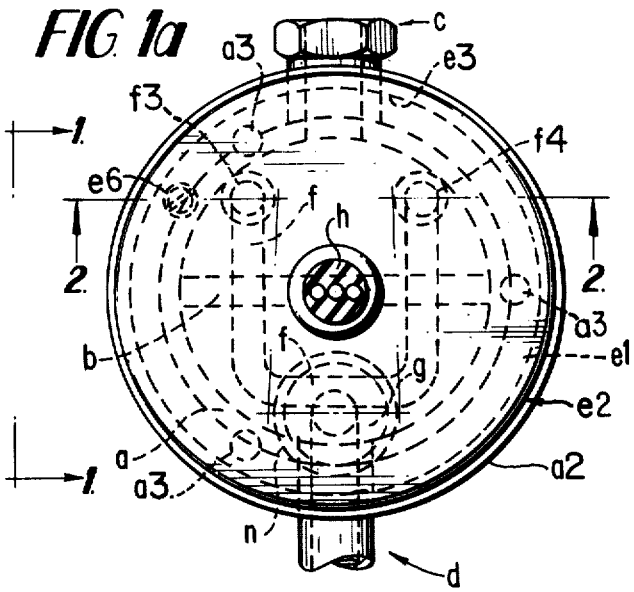
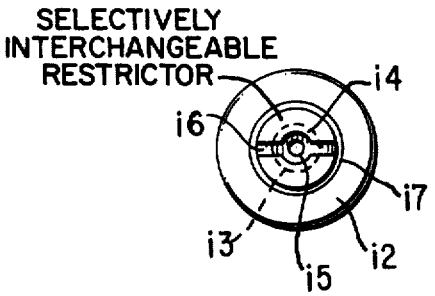
FIG. 3

ELECTRIC WATER HEATER FOR SHOWERS

This invention relates to automatic electric in-line water heaters and aims generally to improve the same.

BACKGROUND OF THE INVENTION

State of the Art

Automatic in-line electric water heaters are known in which the water to be heated is brought into heat absorbing relation to an electrical resistance element which is automatically subjected to the heating current by the flow of the water to be heated. In U.S. Pat. No. 1,057,760 to Miles, a suitably housed piston is moved to close an electrical switch against a spring bias by the pressure of water from a valved supply pipe. The water then passes through a restricted pipe to the mid-height of a vertical cylindrical casing containing bare wire heating coils positioned in a vertical insulating tube open at its ends. The water passes downwardly about the lower portion of the tube and then upwardly in contact with the resistance wires in the tube and then to a delivery spout. The water pressure actuated switch supplies current to the water-immersed electric heating wires. This device leaves much to be desired from the standpoint of safety and reliability and is subject to clogging by sediment collecting in the bottom of the cylindrical casing.

More recently a similar device has been available in which the vertical cylinder has been provided with a removable drain plug at its lower end and a supporting plug at its top, and the bare wire resistance coils and insulating tube have been replaced by an assembly carried by the supporting plug of a U-shaped heating element of the so-called "cal-rod" type having its heating elements embedded in insulating material in a rigid copper tube, and an asbestos partition member positioned to extend within the vertical cylinder between the legs of the U-shaped heating element to cause the water to flow down one side of the partition, under the same, and upwardly on the other side thereof, to a restricted outlet opening, to which a shower bath spray nozzel is attached, a pressure-actuated switch being supported on the supporting plug in a removable metal housing at the top of the device, and communicating with the interior of the cylinder through the plug and controlling the supply of current to the heating element from a standard three conductor cable connected to the switch and heater elements within the removable metal housing. This more recent device represents an improvement over the Miles device but still has disadvantages due to clogging, need to remove the drain plug for clean out, and exposure of electrical connections if one removes the metal housing which could produce a hazardous situation.

SUMMARY OF THE INVENTION

The present invention aims to overcome various of the disadvantages of the aforesaid devices, to provide improved anti-clogging features and to provide improved electrical elements, circuits, and cooperating parts contributing to improve the life and safety of the device. To this end the invention employs, singly and in various combinations, the following features: (1) the locations of the water inlet and outlet are such that the water chamber is essentially full in conjunction with the various sized restricting orifices provided before current is connected to the heating element, preventing burnout. This feature provides protection for the heating element at all times; (2) in a preferred embodiment a divider of the same width as the inside dimension of the circular tube therefore, making it self-centering when inserted inside the tube in conjunction with the heating element, providing a passageway around the heating element from the inlet to the outlet element. This allows the water to be taken off at its highest temperature at the outlet, and the heating element is so related to the inlet and outlet and water flow path that the water is effectively heated without delaterious excessive heating of any portion of the heating means and related parts; (3) the unit is provided with means for cleaning out calcium and sediment entrapment in that it is provided with a removable restrictor at its outlet end and an inlet and outlet on the main body of a large dimension allowing for a rapid flow of water through the unit when the restrictor unit is removed. This flushes out any scale or dirt that may have accumulated in the bottom of the lower assembly. (4) The unit is provided with selectable restrictors and will operate with a wide variety of water pressures providing the proper sized restrictor is installed. The unit has a fixed capacity heating means and to control the temperature at the outlet one varies the flow of the water across the heating element. This is done simply by opening the cutoff valve supplying water to the device for increasing the water flow and lowering the temperature; and if the water supply has a very low water pressure, the selection of the restrictor enables one to increase the size of the orifice to keep the water from becoming too hot. The selection of the proper size orifice in conjunction with the pressure switch thus provides effective control. (5) Especially when used for in-line heating of showers, provision is made to encapsulate and waterproof the heating element and pressure switch in potting compound, such as epoxy resin, for providing complete electrical protection at all times. When used in situations other than in showers such encapsulation and waterproofing may be omitted and the electrical connections may be protected merely by enclosing the same with a removable cover. To enable encapsulation an air chamber is provided at each end of the heating element and around the pressure switch allowing these untis to function in an atmosphere of their own. In the operation of the heating element, if the gas is not allowed to expand into an air chamber, it forms a moist magnesium hydroxide and will short the heating element out. In the case of the pressure switch the air chamber is provided to facilitate operation of the diaphragm and related parts. In conjunction with these features, the Nichrome wire in the heating element is located below the water inlet thereto, which prevents overheating of the pressure sensing control switch, as the heating element is confined to portions of the rigid tubular housing of the heating means which are below the water levels in the unit when operating. The arrangement also allows the whole head along with its insulating qualities to act as a heat sink providing a more stable temperature.

The invention and its several cooperating features will be better understood from the following description of a preferred embodiment thereof, which embodiment is to be considered as illustrative and not restrictive of the invention the scope of which is particularized in the appended claims.

BRIEF DESCRIPTION OF THE DRAWINGS

In the accompanying drawings of the illustrative embodiment,

FIG. 1 is a partly sectional elevation at plane 1—1 in FIG. 1a, of an embodiment adapted for use as a shower heater.

FIG. 1a is a plan view, with part d broken away.

FIG. 2 is a partial section on an enlarged scale taken at 2—2 in FIG. 1a.

FIG. 3 is an end view of the ball joint ball and selectable restrictor to an enlarged scale taken on the plane 3—3 of FIG. 1 looking in the direction indicated by the arrows.

DETAILED DESCRIPTION OF THE ILLUSTRATIVE EMBODIMENT

In the form shown in FIG. 1, the in-line water heater is of the type with a vertical casing *a* closed at its bottom as at *a1* and a friction fit partition *b* assembled to divide said casing into first and second longitudinally extending compartments *b1* and *b2* communicating with each other at their lower ends as indicated at *b3* and essentially separated by said partition *b* at their upper ends as shown. A water inlet *c* is arranged to deliver into the upper end of said first compartment *b1*, and a relatively restricted water outlet *d* is arranged to deliver from said second compartment *b2* at a level intermediate its ends. The improved device comprises a top closure assembly *e* for said casing comprising a base portion *e1* and a removable cover portion *e2* shown in more detail in FIG. 2, the base portion and cover portion defining a receptacle *e3* therein. The base portion *e1* in the improved device is secured to a flange *a2* on the tubular housing *a* by suitable means, viz: three screws *a3*. An electrical heating means *f* having a rigid tubular housing with electrical heating element *f5* (FIG. 2) therein and terminal portions *f1* and *f2* at its ends, is mounted in base portion *e1* by soldering or otherwise, with its ends in said receptacle *e3*. Pressure actuated switch means *g* is also mounted in said receptacle *e3* and has a pressure chamber therein communicating with said casing *a* through said base portion *b1*, as shown. A three conductor current supply means *h* is secured through said assembly *e* with one of its conductors *h1* grounded as by securement under the screw *e6*, and two of its conductors *h2* and *h3* connected to said heating element *f* and switch means *g* in series connection. The free end screw *e6* enters locator hole *a6* to insure correct positioning if assembly *e* is replaced.

In accordance with the present invention the rigid tubular housing *f* is mounted in the base portion *e1* through first and second apertures *e4* and *e5* therein both of which overly the first compartment *b1* at one side of the partition *b*, as shown, and the rigid tubular housing *f* extends downwardly in said first compartment *b1* from its mounting in said first aperture *e4* to a position proximate to the closed bottom *a1* of said vertical casing, thence into and upwardly in the second compartment *b2* to a bend *f3* at a height in a second compartment *b2* lower than the height of said liquid outlet therefrom indicated at *d1*, thence from said bend *f3* downwardly in said compartment *b2* to a position proximate to the closed bottom of said vertical casing and thence into and upwardly in said first compartment *b1* to its mounting in said second aperture *e5*, and said electrical heating element in said tubular housing *f* is confined to those portions of the rigid tubular housing *f* located below the level of the water inlet *c* to the first compartment. In this way when the device is in use the water is effectively heated without excessive heating of the base portion *e1* or of any portion of the heating means as all portions of the heating means to which substantial heat is supplied are immersed in water by the time the switch *g* supplies the heating current.

As above mentioned the relatively restricted outlet *d* delivers from the second compartment at a level *d1* intermediate its end. A trapped air space *b4* is thus provided above the level *d1* at the upper end of the compartment *b2*, and the pressure switch *g* is located so that it communicates with the casing in the trapped air space *b4* above the level of restricted outlet *d1*. In this way while moisture or water vapor may enter the pressure chamber of the pressure switch *g*, clogging of the pressure chamber by deposition of water carried components such as silt or calcium deposits is inhibited.

A cooperating feature of the invention resides in the fact that the water inlet *c* to the compartment *b1* and the water outlet at the level *d1* from the compartment *b2* are of approximately equal inside diameter, and the communication between the first and second compartments at *b3* is of a cross-sectional area such that when water is permitted to flow freely through the casing *a*, silt and sediment clogging said cross-section *b3* is entrained by the flow of water therethrough the restriction of said water outlet, in accordance with the invention, is incorporated in a shower head removably secured to said water outlet. With this arrangement when clogging of the space *b3* is indicated by decrease in water flow and increase in temperature of the water delivered from the showerhead, mere removal of the showerhead for cleaning removes the restriction and allows free flow of water through the casing for flushing the same. Removal of any drain out plug or any other complication is thereby avoided.

In a preferred form of the invention the showerhead is of the ball-joint mounted type and comprises a ball-joint housing *i1* secured to the outlet *d* from said vertical casing *a* as by a packed joint, and a ball unit *i2* (see FIG. 3) sealingly secured to said ball-joint housing as shown in FIG. 1 and having a delivery aperture *i3* therethrough with a restrictor *i4* removably secured in the delivery aperture *i3*. In the form shown in FIG. 3 the restrictor is in the form of a shallow roundhead screw having a bore of selected size *i5* drilled centrally of its axis. The screwhead may be formed with a kerf *i6* to receive a screw driver for mounting and dismounting the retrictor with respect to the ball *i2*. The ball *i2* is provided with a flat face *i7* somewhat larger than the head of the screw *i4*, and the screw head is sufficiently shallow to not extend beyond an extrapolation of the spherical surface above the flattened surface *i7*. The ball *i2* has limited tilting movement in the ball-joint housing *i1*, in which it rests against a conventional ball-joint washer (not shown) and accordingly will not tilt sufficiently in the housing *i1* to cause obstruction of the selected restrictor.

By this provision, by selection from restrictors having different bore sizes one is enabled to obtain substantially the same water flow rate through the casing *a*, and substantially the same desired water discharge temperatures from the spray-head *d* by control of the water supply to said water inlet *c*, from either a relatively low pressure or a relatively high pressure water supply.

As shown in FIG. 2, the terminals *f1* and *f2* are secured to the rigid housing *f* of the heating element through rubber plug means *f3* and *f4* inserted into the ends of the tubular housing *f*, and a thermal and overload fuse means *j* is mounted in the receptacle *e3* in the series connection aforementioned. As is also shown in FIG. 2 to avoid possible hazard, the cover portion *e2* of the top closure assemble is formed of insulating material, and is arranged to be essentially self-locking in the form shown. To this end the base plate *e1* is provided with detent means shown as an undercut edge, and the somewhat flexible or stretchable cap *e2* is provided with tank means to interlock in said detent means, shown as an interrupted inwardly extended flange at its open end.

As is also shown in FIG. 2, the ends of the electrical heating means *f* mounted in the receptacle means *e2* through the base plate *e1* have their terminal portions *f1* and *f2* protruding therefrom, and the heater has plastic air chamber means *m1* and *m2* attached to the ends of the tubular member *f* inside said receptacle for accommodating any matter emitted from said heating means during operation thereof, more particularly the magnesium hydroxide previously mentioned which is sometimes exuded from certain heating elements of the rigid tubular housing form. The terminals *f1* and *f2* as shown protrude through orifices in the walls of said air chamber means *m1*, *m2* and fits snuggly in said orifices, and are connected in said series connection as aforesaid. The space surrounding the plastic air chambers *m1*, *m2* and the series connection within the receptacle *e3* is filled with plastic potting material *p* for encapsulating the same. This plastic potting material, preferably an epoxy resin, may be packed around the parts before assemblying the cover *e2*, or may be applied after such assembly by injection through an orifice in the cover *e2* provided for the purpose.

If desired a plastic air chamber *n* may also be provided to afford an air chamber about the pressure actuated snap action switch *g*, the terminals of which may project through orifices in the walls of the chamber *n*. In this instance, when potting is provided, it may encapsulate the element *n* as well as the other elements mentioned.

For shower installations it is desirable that the snap action switch *g* be provided with a pressure diaphragm and spring bias such as to cause it to become closed to "on" position at a pressure of about 4½ psi in said pressure chamber and become open to "off" position at a pressure at about 2½ psi in said pressure chamber, whereby delivery of excessively hot water through reduction of the water supply through the inlet, is inhibited.

While there have been described herein what are at present considered preferred embodiments of the several features of the invention, it will be obvious to those skilled in the art that modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

I claim:

1. An improved automatic electric in-line water heater of the type having (a) a hollow vertical casing closed at its bottom and open at its top, (b) a vertical partition dividing said casing into first and second longitudinally extending compartments communicating with each other at their lower ends, and essentially separated by said partition at their upper ends, (c) a water inlet delivering into the upper portion of one of said first and second compartment, (d) a relatively restricted water outlet delivering from the upper part of the other of said first and second compartments, (e) said heater having a top closure assembly for said casing comprising a base portion covering said open casing top and a removable cover portion defining with said base portion a receptacle, (f) an electrical heating means having a rigid tubular housing with an electrical heating element therein and terminal portions at its ends, said heating means being mounted in said base portion with its ends in said receptacle, (g) pressure-actuated switch means in said receptacle having a pressure chamber therein communicating with said casing through said base portion, and (h) three conductor current supply means secured to said assembly with one of its conductors grounded and two of its conductors connected to said heating element and switch means in series connection, and including the improvement that (i) said rigid tubular housing is mounted in said base portion through first and second apertures therein both overlying said first compartment at one side of said partition, (j) said rigid tubular housing extends downwardly in said first compartment from its mounting in said first aperture to a position proximate to the closed bottom of said vertical casing, thence into and upwardly in said second compartment to a bend at a height therein lower than the height of said liquid outlet from said casing, thence from said bend downwardly in said second compartment to a position proximate to the closed bottom of said vertical casing, and thence into and upwardly in said first compartment to its mounting in said second aperture, and (k) said electrical heating element is confined to those portions of said rigid tubular housing located below the level of said water inlet, whereby in use said water is effectively heated without excessive heating of said base portion or of any portion of said heating means.

2. An improved automatic electric in-line water heater according to claim 1, wherein (1) the pressure chamber of said pressure-actuated switch communicates with a trapped air space in said casing above the relatively restricted water outlet therefrom, whereby deposition of water-carried components in said pressure chamber is inhibited.

3. An improved automatic electric in-line water heater according to claim 1, wherein (1) said water inlet and water outlet from said compartments comprise conduits of approximately equal inside diameter and the communication between said first and second compartments at their lower ends is of a cross-sectional area such that, when water is permitted to flow freely through said casing, silt and sediment clogging said cross-section is entrained by the flow of water therethrough, and the restriction of said water outlet is incorporated in a shower-head removably secured to said water outlet, whereby removal of said shower-head for cleaning removes said restriction and allows free flow of water through said casing for flushing the same.

4. An improved automatic electric in-line water heater according to claim 1, wherein (1) said restricted outlet comprises a ball-joint having a ball-joint housing sealingly secured to said vertical casing and a ball-joint ball removably sealed to said ball-joint housing and having a delivery aperture therethrough with a restriction of selected bore-size removably secured in said delivery aperture, whereby selection from restrictions of different bore sizes enables substantially the same water flow rate through said casing and substantially the same desired water discharge temperatures therefrom to be attained by control of the water supply to said water inlet from either a relatively low pressure or a relatively high pressure supply.

5. An improved automatic electric in-line water heater according to claim 1, further comprising (1) thermal and overload fuse means located in said receptacle and connected in said series connection.

6. An improved automatic electric in-line water heater according to claim 1, wherein said pressure switch is a snap-action pressure switch spring biased to open position when not closed by fluid pressure in said pressure chamber.

7. An improved automatic electric in-line water heater according to claim 1, wherein said snap-action switch is provided with a pressure diaphram and spring bias such as to cause it to become closed to "on" position at a pressure of about 4½ psi in said pressure chamber and to become opened to "off" position at a pressure of about 2½ psi in said pressure chamber, whereby delivery of excessively hot water in response to reduction of the water supply through said inlet is inhibited.

8. An improved automatic electric in-line water heater according to claim 1, wherein (l) the ends of said electrical heating means mounted in said receptacle have said terminal portions protruding therefrom, said heater further having (m) plastic air chamber means attached to said ends of said heating means inside said receptacle for accommodating any matter emitted from said heating means during operation thereof, said terminals protruding through orifices in the walls of said air chamber means and fitting snugly in said orifices, and p1 (n) plastic potting material filling the space within said receptacle surrounding said plastic air chamber means and said series connection and encapsulating the same.

9. An improved automatic electric in-line water heater according to claim 8, further comprising (o) a plastic air chamber means attached to said pressure actuating switch inside said receptacle in at least partially surrounding relation thereto for accommodating any matter emitted from said switch during operation thereof, said switch and last mentioned air chamber means being also encapsulated by said potting material.

10. An improved automatic electric in-line water heater according to claim 1, wherein (1) said removable cover portion of said top closure assembly is formed of electric insulating material and comprises elements essentially locking the same to said base portion for preventing access to said receptacle after its assembly.

* * * * *